US011395545B2

(12) United States Patent
Lin et al.

(10) Patent No.: US 11,395,545 B2
(45) Date of Patent: Jul. 26, 2022

(54) FRONT CONNECTION DEVICE FOR MODULAR ADJUSTMENT OF DRAWER SLIDES

(71) Applicant: GUANGDONG HEGU HARDWARE PRECISION MANUFACTURING CO, LTD., Guangdong (CN)

(72) Inventors: Zhaofeng Lin, Guangdong (CN); Wenqiang Wu, Guangdong (CN); Xiaobing Gong, Guangdong (CN)

(73) Assignee: GUANGDONG HEGU HARDWARE PRECISION MANUFACTURING CO, LTD., Jieyang (CN)

( * ) Notice: Subject to any disclaimer, the term of this patent is extended or adjusted under 35 U.S.C. 154(b) by 0 days.

(21) Appl. No.: 17/265,533

(22) PCT Filed: Oct. 29, 2019

(86) PCT No.: PCT/CN2019/113939

§ 371 (c)(1),
(2) Date: Feb. 3, 2021

(87) PCT Pub. No.: WO2020/140594

PCT Pub. Date: Jul. 9, 2020

(65) Prior Publication Data

US 2021/0307512 A1 Oct. 7, 2021

(30) Foreign Application Priority Data

Dec. 30, 2018 (CN) ..... 201811647312.6

(51) Int. Cl.
*A47B 88/427* (2017.01)

(52) U.S. Cl.
CPC .... *A47B 88/427* (2017.01); *A47B 2088/4276* (2017.01); *A47B 2210/0054* (2013.01)

(58) Field of Classification Search
CPC ..... A47B 88/423; A47B 88/427; A47B 2088/4276; A47B 2210/0054
See application file for complete search history.

(56) References Cited

U.S. PATENT DOCUMENTS 11,039,687 B1 * 6/2021 McGregor ..... A47B 88/407
2002/0158557 A1 * 10/2002 Weichelt ..... A47B 88/427 312/334.4

(Continued)

FOREIGN PATENT DOCUMENTS

CN 104622050 A 5/2015
CN 209518551 U 10/2019

OTHER PUBLICATIONS

International search report of PCT Patent Application No. PCT/CN2019/113939 dated Feb. 1, 2020.

*Primary Examiner* — Daniel J Rohrhoff

(57) ABSTRACT

The present invention provides a front connection device for modular adjustment of drawer slides, comprising a movable base, an integrated adjustment module and an integrated longitudinal adjustment module, the integrated adjustment module comprises an integrated main frame, a latch handle component and a vertical adjustment component, the integrated main frame is positionally installed with the movable slide, the latch handle component is axially connected to the integrated main frame; and the integrated adjustment module is provided with a lateral adjustment component. The positions of the integrated main frame, the vertical adjustment component and the latch handle component with the movable slide are kept unchanged, the movable base is moved laterally, combined the vertical adjustment component and the longitudinal adjustment component, a drawer can perform multi-directional modular adjustment. The (Continued)

present invention is stable and reliable, is installed and removed without tools, reduces cost and is suitable as DIY optional installation.

9 Claims, 11 Drawing Sheets

(56) References Cited

U.S. PATENT DOCUMENTS

| | | | | |
|---|---|---|---|---|
| 2015/0342347 | A1* | 12/2015 | McGregor | A47B 88/427 384/22 |
| 2017/0347794 | A1* | 12/2017 | McGregor | A47B 88/49 |
| 2019/0090633 | A1* | 3/2019 | Hsu | A47B 88/477 |
| 2020/0383474 | A1* | 12/2020 | Hayes | A47B 88/447 |
| 2021/0307511 | A1* | 10/2021 | McGregor | A47B 88/427 |

* cited by examiner

FRONT CONNECTION DEVICE FOR MODULAR ADJUSTMENT OF DRAWER SLIDES

FIELD OF INVENTION

The present invention relates to the technical field of slides, and particularly relates to a front connection device for modular adjustment of drawer slides.

BACKGROUND ART OF THE INVENTION

In the existing multi-directional adjustment device for adjusting the installation position between a drawer and a slide, the vertical adjustment component and the latch handle component are generally fixed on the base of the adjustment device. When a user makes lateral adjustment to the drawer, the vertical adjustment component, the latch handle component and the base are moved integrally so that the positions of contact between the vertical adjustment component, the latch handle component and the base with the slide all move, which easily causes deformation resulting in failure of adjustment functions and disconnection of the latch and the slide of the device, even damage; and in the process of adjustment, the drag is high, the comfort level of use is low, the durability declines, many installation procedures are required, and the cost is high.

In addition, the longitudinal adjustment function of the similar adjustment devices now on the market is generally realized in the form of integral forming or fixing with tools and screws, which brings difficulties in selective assembly, installation and removal for general DIY users, is not conducive to modular production and requires high cost.

Therefore, to achieve the stability, effectiveness and durability of the product, reduce manufacturing cost and provide better selective assembly and convenient installation and removal methods, it is necessary to make further innovation and improvement on the multi-direction adjustment device.

DISCLOSURE OF THE INVENTION

The purpose of the present invention is to overcome the defects of the prior art and provide a front connection device for modular adjustment of drawer slides, which has simple and reasonable structure, modular functions, convenient tool-less installation and removal, convenient and comfortable adjustment, and stable performance and can make lateral, vertical and longitudinal adjustment to the drawer under the condition that the position of connection with the slide is kept unchanged in use.

The purpose of the present invention is achieved as follows: a front connection device for modular adjustment of drawer slides comprises a movable base installed on a drawer, an integrated adjustment module for integrated adjustment of lateral and vertical installation positions of the drawer, and an integrated longitudinal adjustment module for adjusting the longitudinal installation position of the drawer, wherein the integrated longitudinal adjustment module is fastened on the movable base and positionally connected with the front end of a movable slide, and the integrated adjustment module is slidably installed on the movable base and positionally installed with the movable slide;

The integrated adjustment module comprises an integrated main frame, a latch handle component and a vertical adjustment component, the integrated main frame is laterally slidably installed on the movable base and positionally installed with the movable slide, the latch handle component is axially connected to the integrated main frame and rotatably fastened on the movable slide with an axis as a fixed point, and the vertical adjustment component is longitudinally slidably installed on the integrated main frame and provided with an inclined plane which is slidably connected with the bottom surface of the movable slide;

The integrated adjustment module is provided with a lateral adjustment component for lateral movement of the movable base under the condition that the positions of connection between the integrated main frame, the vertical adjustment component and the latch handle component with the movable slide are kept unchanged when the drawer is laterally adjusted.

According to above optimization, the integrated longitudinal adjustment module comprises a longitudinal adjustment base, and the longitudinal adjustment base is provided with a longitudinal adjustment component for longitudinal movement of the drawer under the condition that the positions of connection between the integrated main frame, the vertical adjustment component, the latch handle component and the movable base with the movable slide are kept unchanged when the drawer is longitudinally adjusted.

According to above optimization, the longitudinal adjustment component comprises a longitudinal adjustment wheel and a longitudinal adjustment block with a longitudinal adjustment screw rod, the longitudinal adjustment block is longitudinally slidably installed on the longitudinal adjustment base, the longitudinal adjustment wheel is in threaded connection with the longitudinal adjustment screw rod and drives the longitudinal adjustment block to longitudinally move relative to the longitudinal adjustment base during rotation of the longitudinal adjustment screw rod, and the longitudinal adjustment base is fastened on the movable base.

According to above optimization, the longitudinal adjustment base is provided with an integrally formed longitudinal fastening part, and one side of the movable base is provided with a fastening hole for fastening the longitudinal fastening part.

According to above optimization, the lateral adjustment component comprises a lateral adjustment wheel and a lateral adjustment screw rod integrated with the integrated main frame;

The vertical adjustment component comprises a vertical adjustment block, and the vertical adjustment block is provided with a vertical adjustment wheel and a vertical adjustment screw rod integrated with the vertical adjustment block;

The latch handle component comprises a movable fastener and a movable handle;

The movable handle is axially connected to the integrated main frame, and the movable fastener is fastened on the fastening part of the movable handle and fastened on or separated from the movable slide with the swinging of the movable handle;

The vertical adjustment block is longitudinally slidably installed on the integrated main frame, the inclined plane is arranged on the rear end of the vertical adjustment block, and the vertical adjustment wheel is in threaded connection with the vertical adjustment screw rod and drives the inclined plane to longitudinally slide on the bottom surface of the movable slide during rotation of the vertical adjustment wheel to move the drawer up and down;

The integrated main frame is laterally slidably installed on the movable base, and the rear end of the integrated main frame is integrated with a positioning connecting block positionally installed with the movable slide;

The lateral adjustment wheel is in threaded connection with the lateral adjustment screw rod and drives the movable base to laterally move relative to the movable slide during rotation of the lateral adjustment screw rod.

According to above optimization, the movable base is provided with a lateral guiding detent which is fastened on the lateral adjustment screw rod and can slide laterally along the lateral adjustment screw rod.

According to above optimization, the movable base is integrated with a lateral guiding convex block and a lateral guiding clamping block, the integrated main frame is provided with a lateral guide slot slidably installed with the lateral guiding convex block and a guiding connecting block which is fastened on the lateral guiding clamping block and can slide laterally along the lateral guiding clamping block.

According to above optimization, the integrated main frame is integrated with an elastic connecting block elastically connected with the front end of the movable slide.

According to above optimization, the integrated main frame is provided with a vertical guiding detent which is fastened on the vertical adjustment screw rod and slides longitudinally along the vertical adjustment screw rod.

According to above optimization, the vertical adjustment block is provided with a vertical guide slot, a vertical guide groove and a vertical guiding convex block integrated therewith, a vertical guiding clamping block and a vertical guiding connecting position;

The integrated main frame is provided with a vertical connecting convex block matched with and longitudinally slidably installed with the vertical guide slot, a guide notch matched with and longitudinally slidably installed with the vertical guiding convex block, a vertical connecting block which is fastened with the vertical guiding clamping block and can be longitudinally slidably installed along the vertical guiding clamping block, and a vertical guiding fastening block which is clamped with the vertical guiding connecting position and can be longitudinally slidably installed along the vertical guiding connecting position;

The bottom surface of the movable base is integrated with a lateral connecting block which is clamped with the vertical guide groove and can slide laterally.

The present invention has the advantages that:

1) The structure matching of the movable base, the integrated main frame of the integrated adjustment module and the latch handle component is used to make the movable base fixed to the drawer move laterally under the condition that the positions of connection between the integrated main frame, the vertical adjustment component and the latch handle component with the movable slide are kept unchanged when the lateral adjustment component is rotated; the adjustment drag and the deformation rate are reduced, the adjustment stability and the product durability are improved, the adjustment comfort level is increased, and the quality in use of the product is ensured.

2) Under the action of the lateral adjustment component, the vertical adjustment component and the longitudinal adjustment component, the lateral, vertical and longitudinal installation positions of the drawer can be adjusted, multi-directional adjustment is realized, the operation is convenient and flexible, and the installation effect of the drawer is ensured.

3) The assembly of the movable base, the integrated adjustment module and the integrated longitudinal adjustment module into a front connection device for modular adjustment of drawer slides by modularization is suitable for modular production and conductive to increasing production efficiency and reducing cost as well as improves the stability and effectiveness of the product, provides the functions of free selective assembly and tool-free installation and removal, facilitates selective assembly DIY and quick tool-free installation and removal of users, and has high applicability.

DETAILED DESCRIPTION OF THE INVENTION

The present invention will be further described as below with reference to the drawings.

Figure 1:
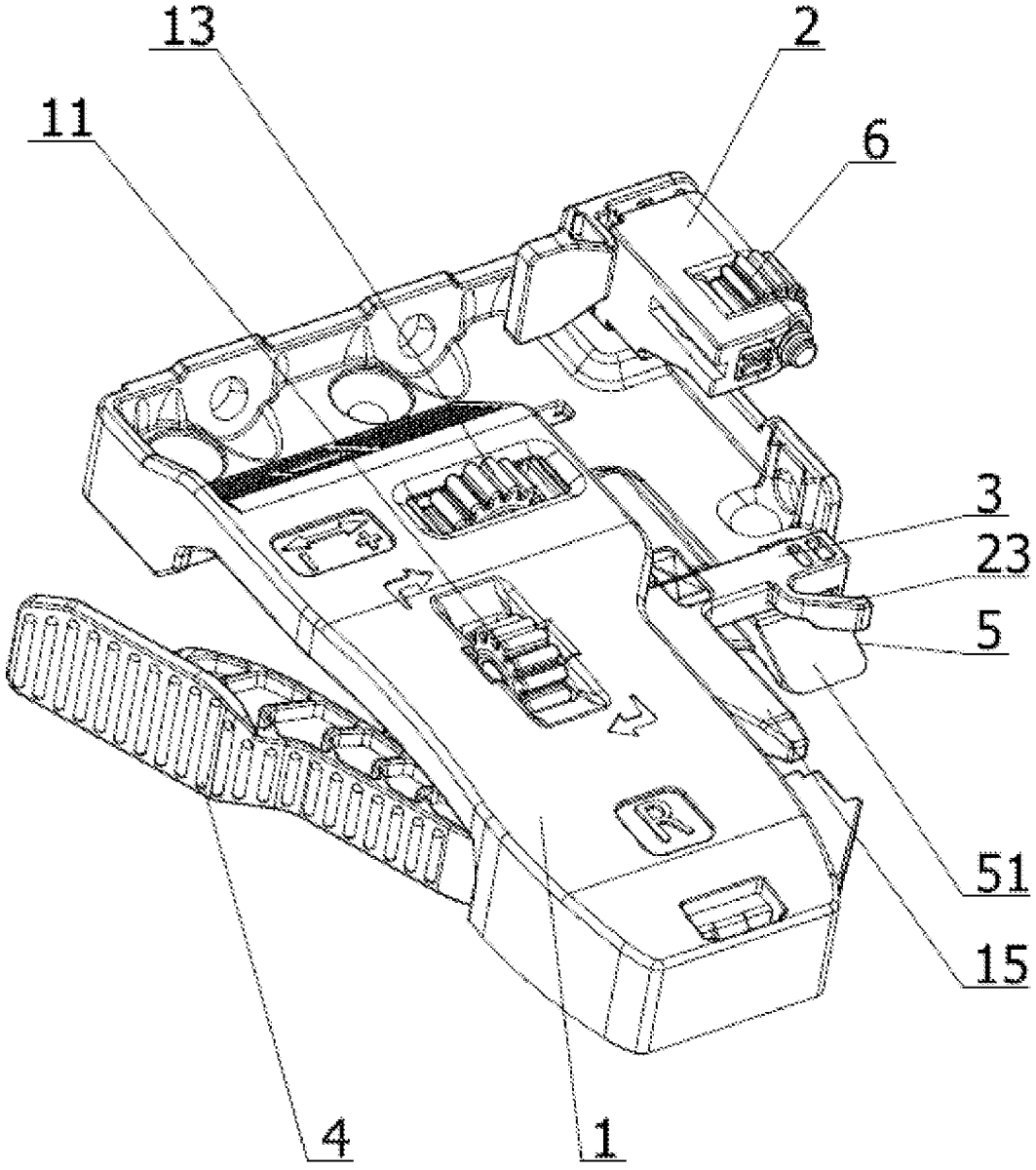
FIG. 1 is a structural schematic diagram of the preferred embodiment of the present invention.
Figure 2:
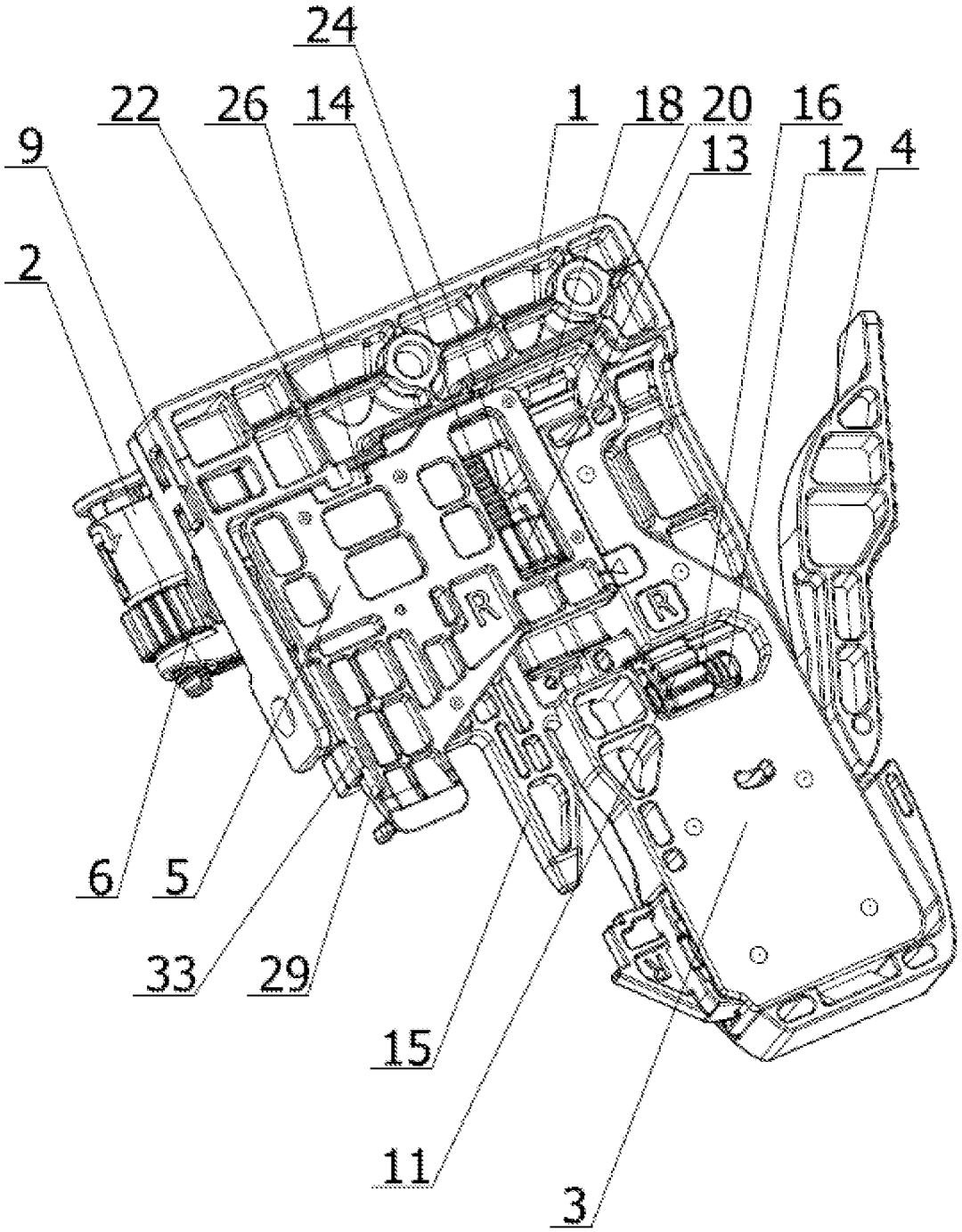
FIG. 2 is a structural schematic diagram of another angle of the preferred embodiment of the present invention.
Figure 3:
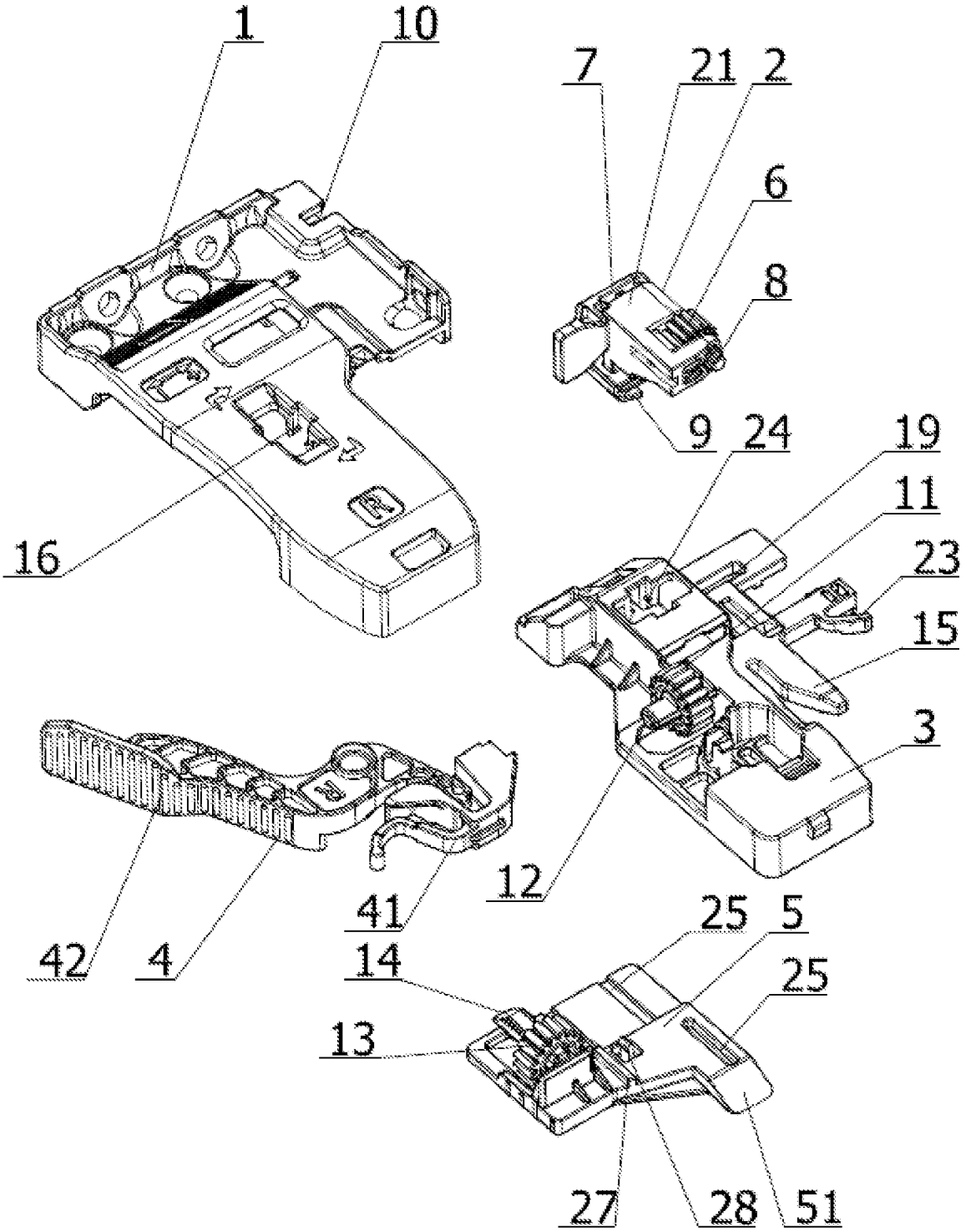
FIG. 3 is an exploded view of the preferred embodiment of the present invention.
Figure 4:
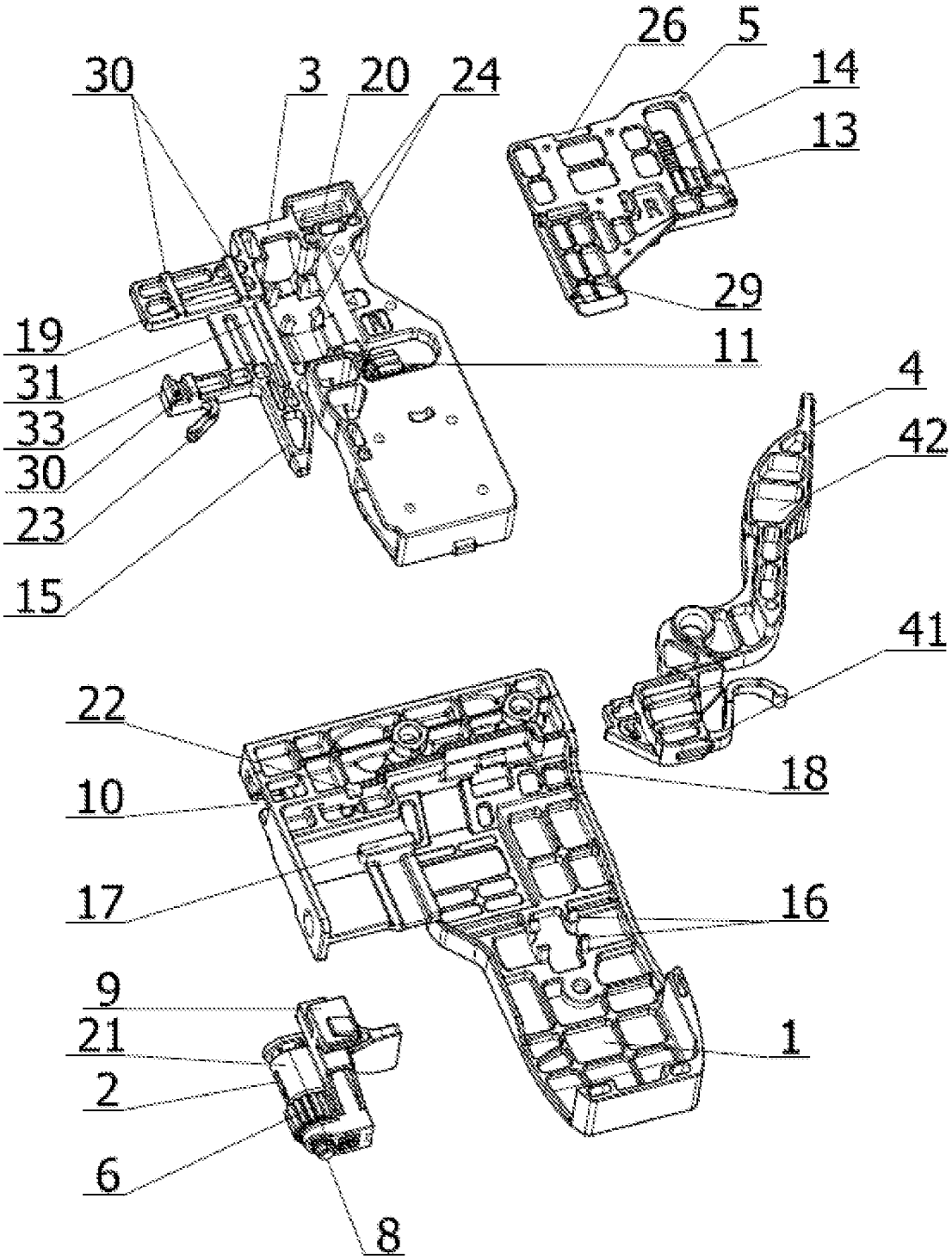
FIG. 4 is an exploded view of another angle of the preferred embodiment of the present invention.
Figure 5:
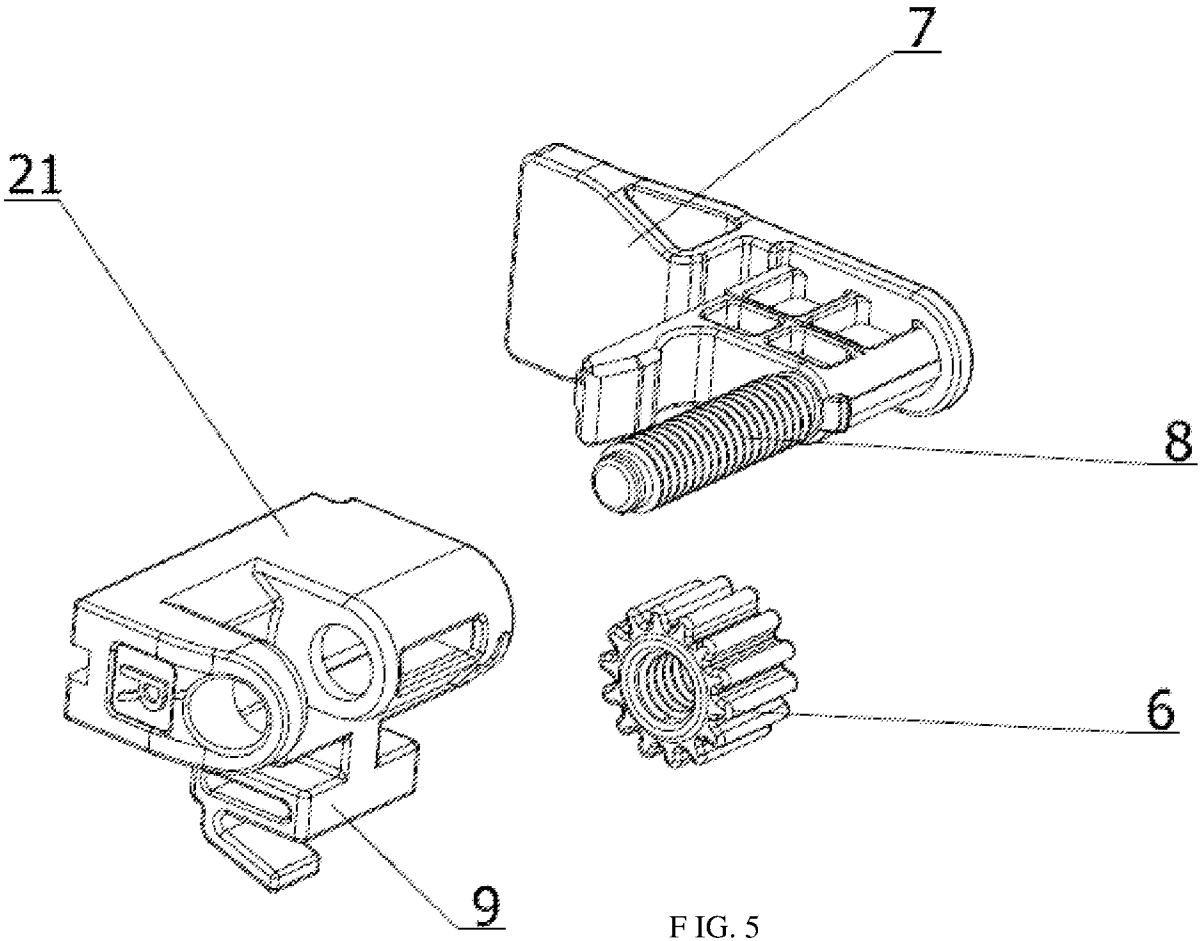
FIG. 5 is an exploded view of the longitudinal adjustment component in the preferred embodiment of the present invention.
Figure 6:
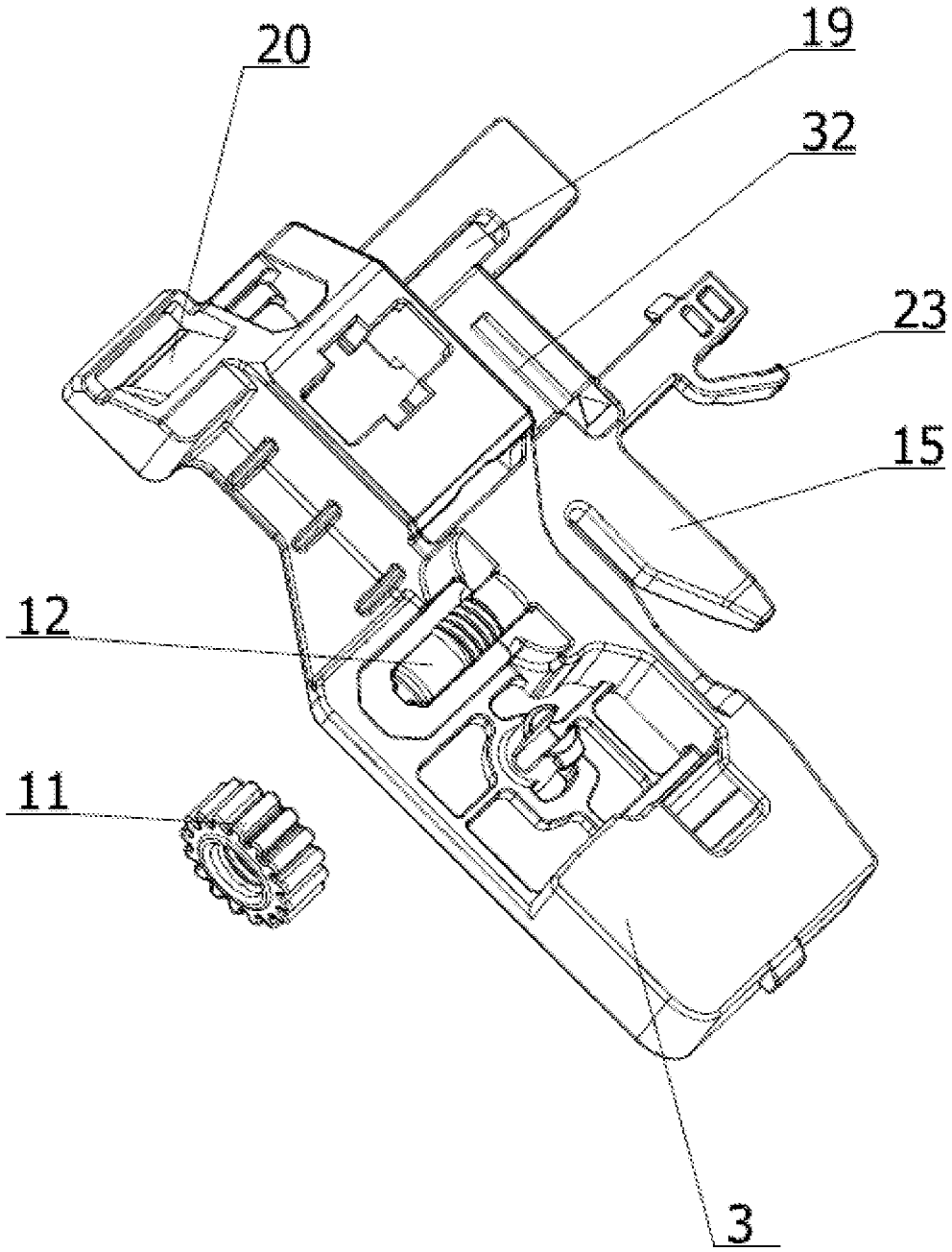
FIG. 6 is an exploded view of the lateral adjustment component in the preferred embodiment of the present invention.
Figure 7:
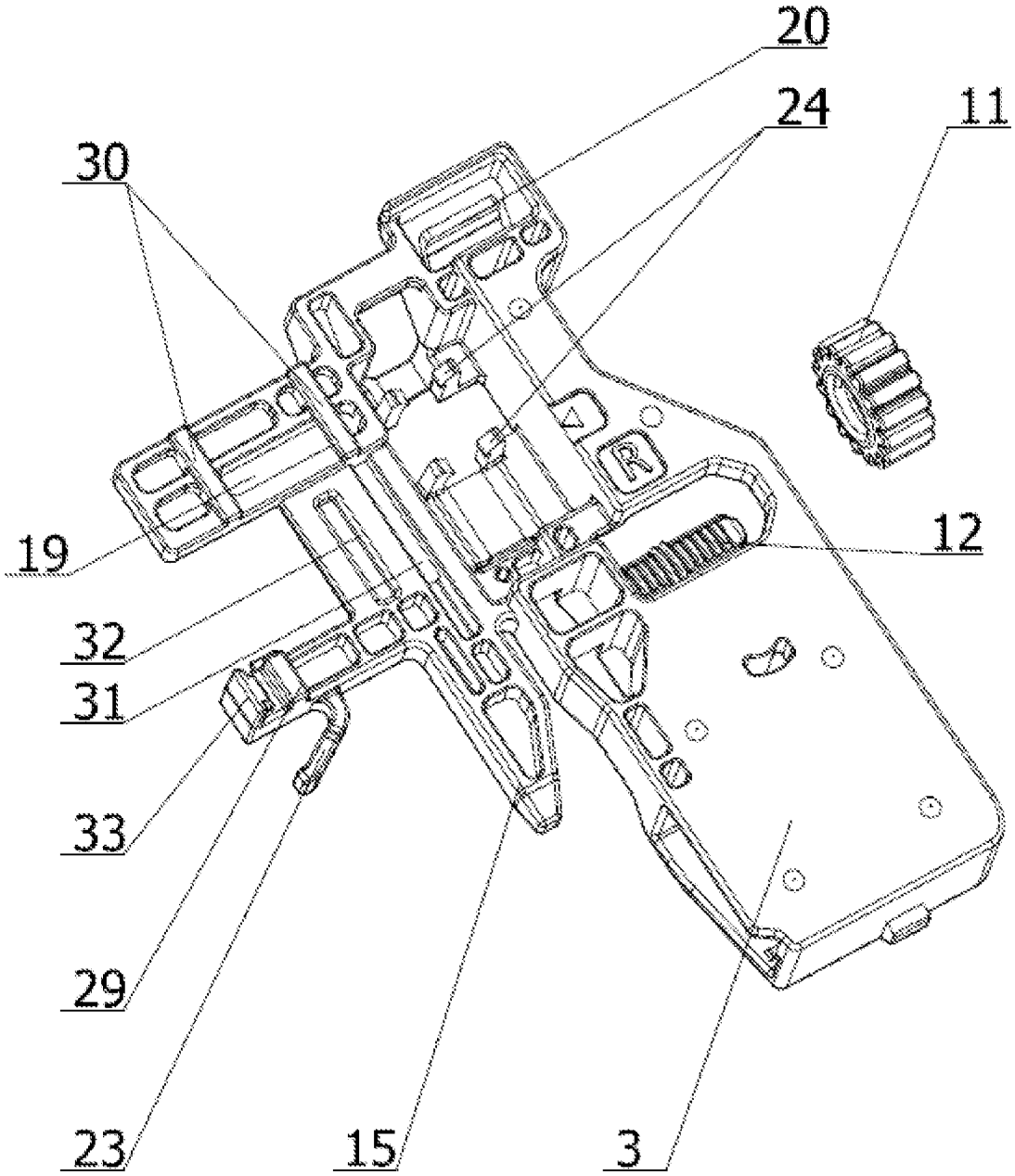
FIG. 7 is an exploded view of another angle of the lateral adjustment component in the preferred embodiment of the present invention.
Figure 8:
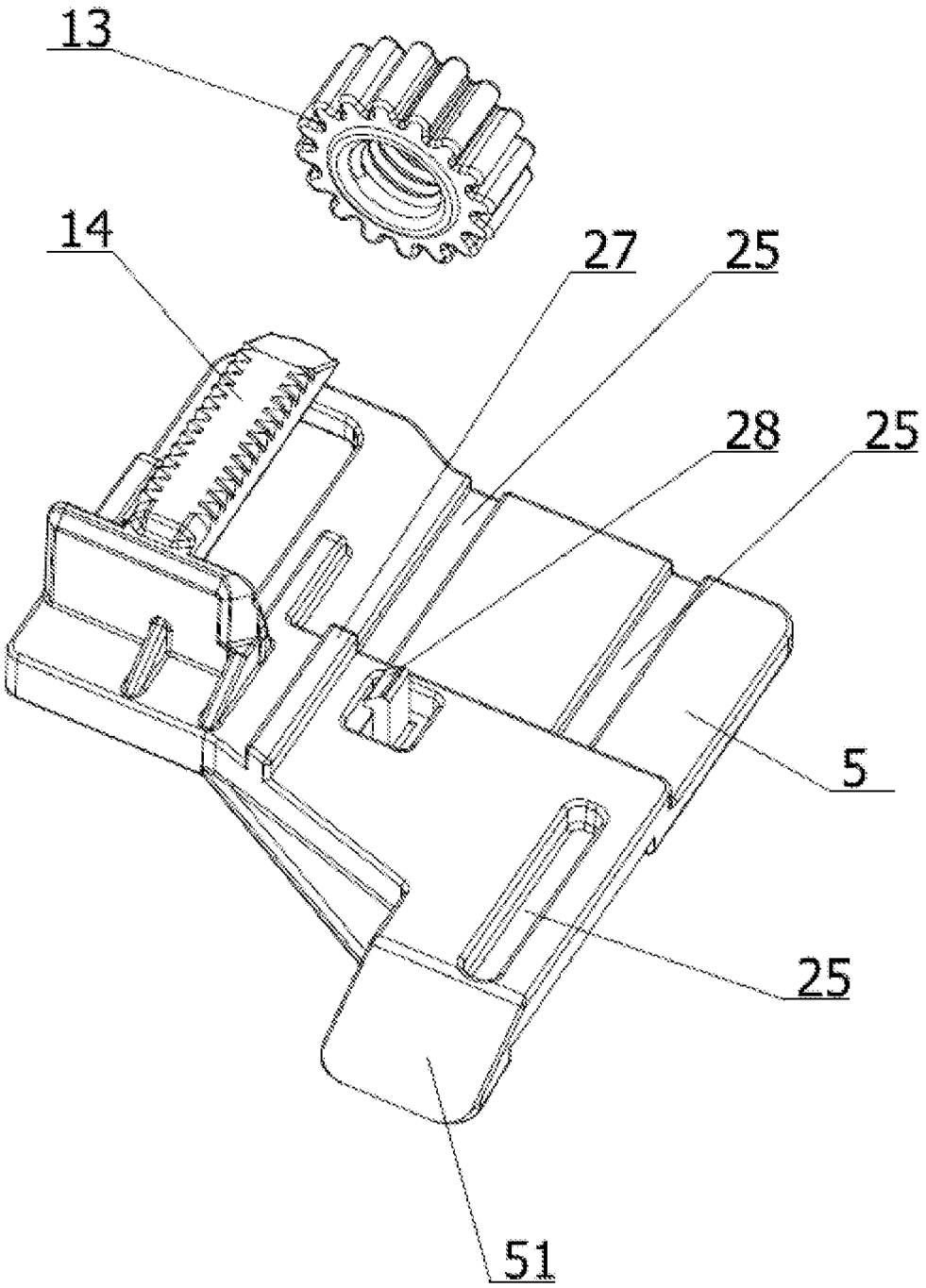
FIG. 8 is an exploded view of the vertical adjustment component in the preferred embodiment of the present invention.
Figure 9:
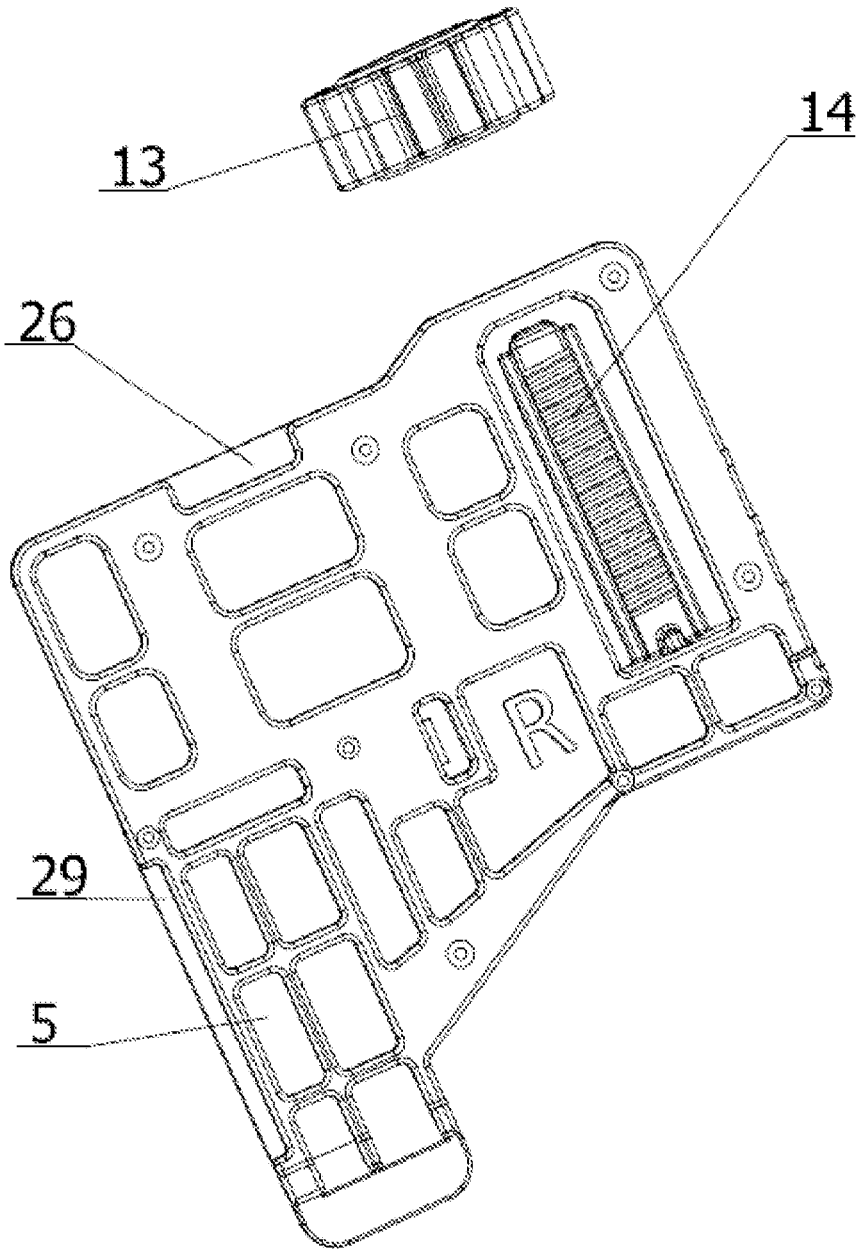
FIG. 9 is an exploded view of another angle of the vertical adjustment component in the preferred embodiment of the present invention.
Figure 10:
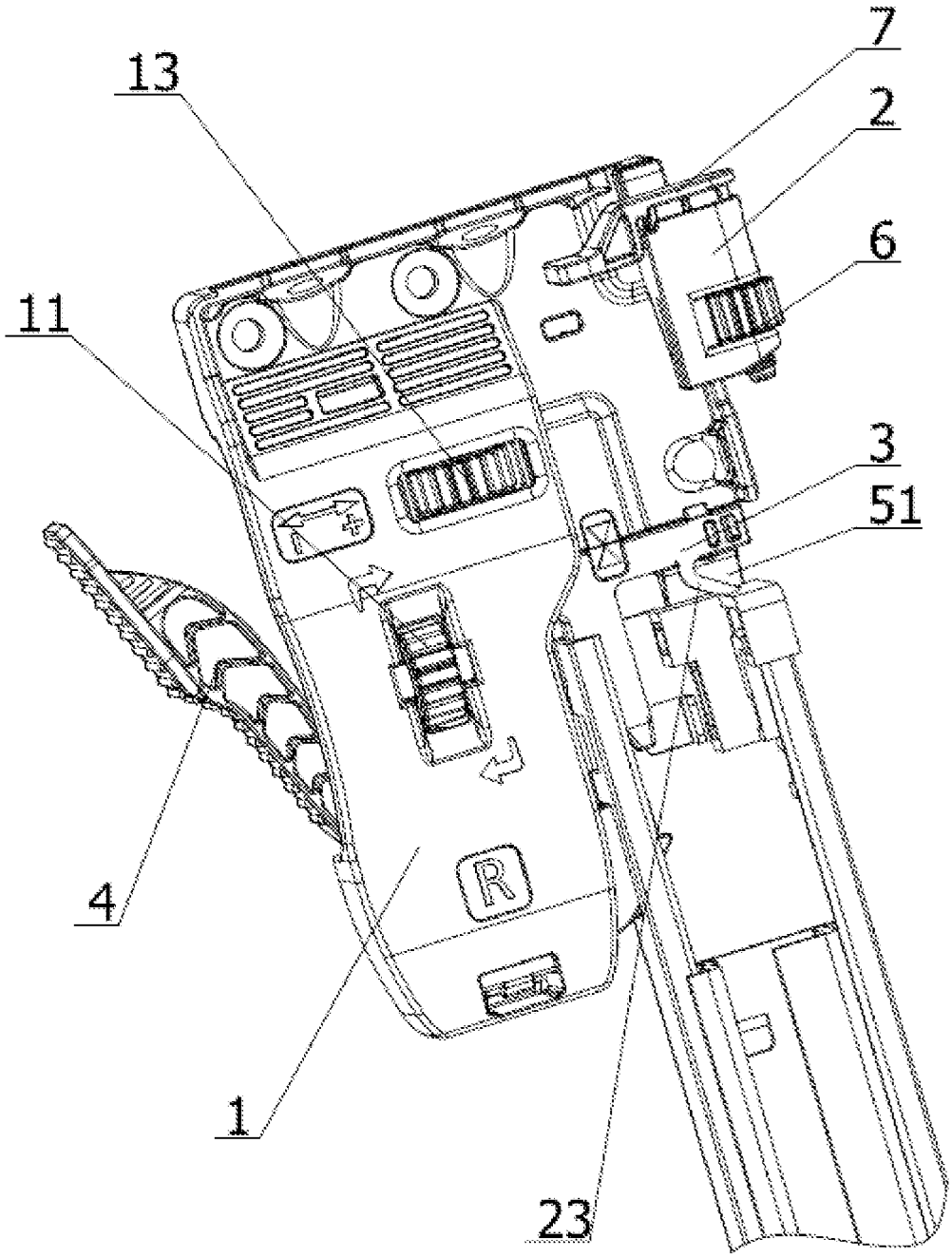
FIG. 10 is a schematic diagram of installation relationship between the preferred embodiment and the movable slide of the present invention.
Figure 11:
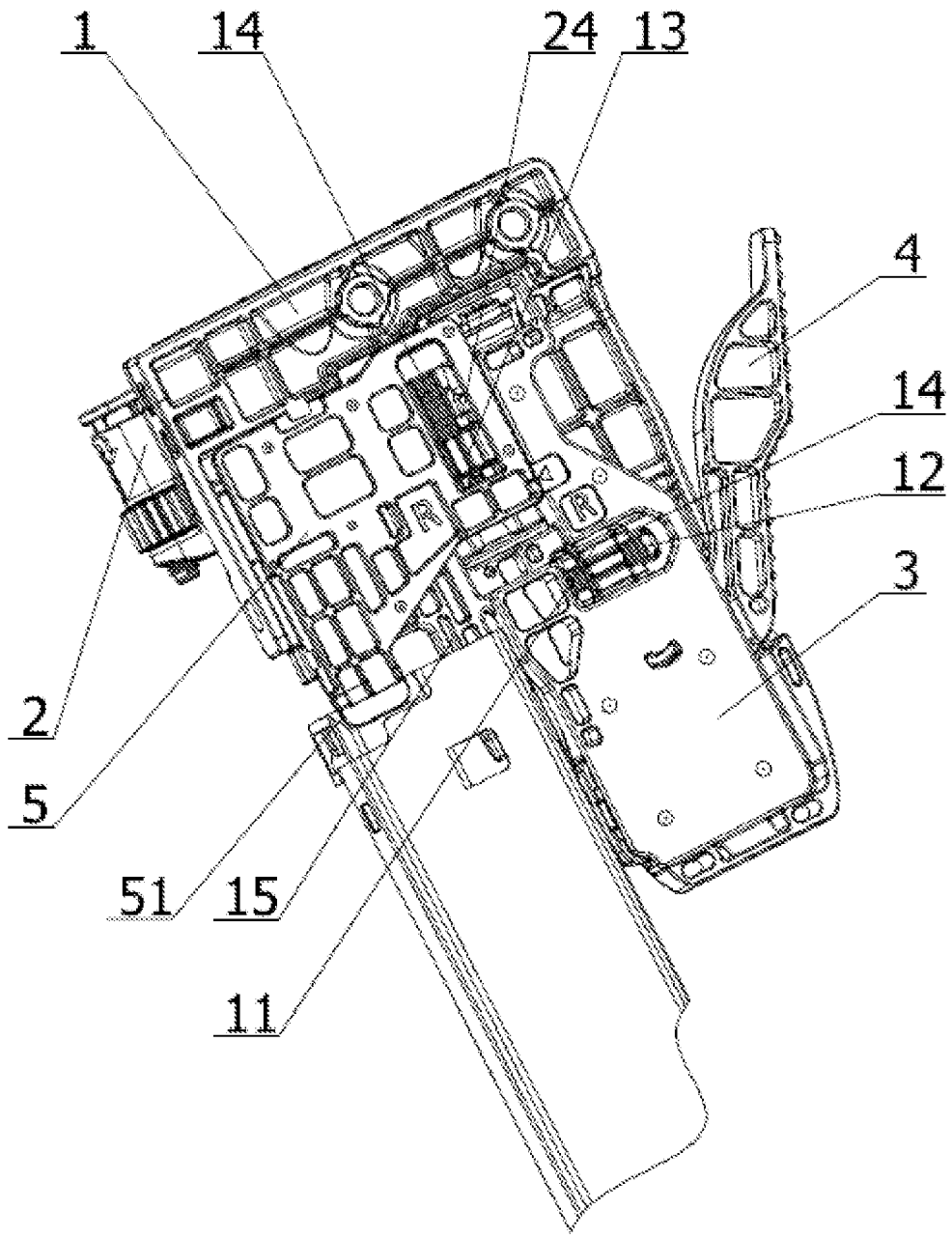
FIG. 11 is a schematic diagram of another angle of installation relationship between the preferred embodiment and the movable slide of the present invention.

As shown in FIG. 1 to FIG. 11, the front connection device for modular adjustment of drawer slides of the present invention comprises a movable base 1 installed on a drawer, an integrated adjustment module for integrated adjustment of lateral and vertical installation positions of the drawer, and an integrated longitudinal adjustment module 2 for adjusting the longitudinal installation position of the drawer, wherein the integrated longitudinal adjustment module 2 is fastened on the movable base 1 and positionally connected with the front end of a movable slide, and the integrated adjustment module is slidably installed on the movable base 1 and positionally installed with the movable slide.

Wherein the integrated adjustment module comprises an integrated main frame 3, a latch handle component 4 and a vertical adjustment component, the integrated main frame 3 is laterally slidably installed on the movable base 1 and positionally installed with the movable slide, the latch handle component 4 is axially connected to the integrated main frame 3 and rotatably fastened on the movable slide with an axis as a fixed point, and the vertical adjustment component is longitudinally slidably installed on the integrated main frame 3 and provided with an inclined plane 51 which is slidably connected with the bottom surface of the movable slide.

Moreover, the integrated adjustment module is provided with a lateral adjustment component for lateral movement of the movable base 1 under the condition that the positions of connection between the integrated main frame 3, the vertical adjustment component and the latch handle component 4 with the movable slide are kept unchanged when the drawer is laterally adjusted.

When the drawer is adjusted laterally, it is only necessary to rotate the lateral adjustment component to keep the positions of connection between the integrated main frame 3, the vertical adjustment component and the latch handle component 4 with the movable slide unchanged and make the movable base 1 move laterally. The adjustment drag and the deformation rate are reduced, the adjustment stability and the product durability are improved, the adjustment comfort level is increased, and the quality in use of the product is ensured.

Further, as shown in FIG. 1 to FIG. 11, the integrated longitudinal adjustment module 2 comprises a longitudinal adjustment base 21. The longitudinal adjustment base 21 is provided with a longitudinal adjustment component for longitudinal movement of the drawer under the condition that the positions of connection between the integrated main frame 3, the vertical adjustment component, the latch handle component 4 and the movable base 1 with the movable slide are kept unchanged when the drawer is longitudinally adjusted.

The longitudinal adjustment component comprises a longitudinal adjustment wheel 6 and a longitudinal adjustment block 7 with a longitudinal adjustment screw rod 8, the longitudinal adjustment block 7 is longitudinally slidably installed on the longitudinal adjustment base 21, the longitudinal adjustment wheel 6 is in threaded connection with the longitudinal adjustment screw rod 8 and drives the longitudinal adjustment block 7 to longitudinally move relative to the longitudinal adjustment base 21 during rotation of the longitudinal adjustment screw rod 8, and the longitudinal adjustment base 21 is fastened on the movable base 1.

Further, as shown in FIG. 1 to FIG. 11, the lateral adjustment component comprises a lateral adjustment wheel 11 and a lateral adjustment screw rod 12 integrated with the integrated main frame 3. The lateral adjustment wheel 11 is in threaded connection with the lateral adjustment screw rod 12 and drives the movable base 1 to laterally move relative to the movable slide during rotation of the lateral adjustment screw rod 12.

Moreover, the latch handle component 4 comprises a movable fastener 41 and a movable handle 42. The movable handle 42 is axially connected to the integrated main frame 3, and the movable fastener 41 is fastened on the fastening part of the movable handle 42 and fastened on or separated from the movable slide with the swinging of the movable handle 42.

In addition, the integrated main frame 3 is laterally slidably installed on the movable base 1, and the rear end of the integrated main frame 3 is integrated with a positioning connecting block 15 positionally installed with the movable slide.

That is, when the drawer is adjusted laterally, the lateral adjustment wheel 11 is rotated to make the lateral adjustment screw rod 12 laterally slide relative to the lateral adjustment wheel 11 so as to keep the positions of connection between the integrated main frame 3, the vertical adjustment component and the latch handle component 4 with the movable slide unchanged and make the movable base 1 move laterally.

In the meantime, the integrated main frame 3 is integrated with an elastic connecting block 23 elastically connected with the front end of the movable slide. The deformation rate is reduced, the adjustment stability and the product durability are improved, the adjustment comfort level is increased, and the quality in use of the product is ensured.

Further, as shown in FIG. 1 to FIG. 11, the vertical adjustment component comprises a vertical adjustment block 5, and the vertical adjustment block 5 is provided with a vertical adjustment wheel 13 and a vertical adjustment screw rod 14 integrated with the vertical adjustment block 5. The vertical adjustment block 5 is longitudinally slidably installed on the integrated main frame 3, and the inclined plane 51 is arranged on the rear end of the vertical adjustment block 5. Moreover, the vertical adjustment wheel 13 is in threaded connection with the vertical adjustment screw rod 14 and drives the inclined plane 51 to longitudinally slide on the bottom surface of the movable slide during rotation of the vertical adjustment wheel 13 to move the drawer up and down.

When the drawer is vertically adjusted, it is only necessary to rotate the vertical adjustment wheel 13 to make the vertical adjustment block 5 longitudinally slide on the integrated main frame 3 and move the drawer up and down under the action of the inclined plane 51.

In this way, under the action of the lateral adjustment component, the vertical adjustment component and the longitudinal adjustment component, the lateral, vertical and longitudinal installation positions of the drawer can be adjusted, multi-directional adjustment is realized, the operation is convenient and flexible, the installation accuracy is increased, and the installation effect of the drawer is ensured.

Further, as shown in FIG. 1 to FIG. 11, the longitudinal adjustment base 21 is provided with an integrally formed longitudinal fastening part 9, and one side of the movable base 1 is provided with a fastening hole 10 for fastening the longitudinal fastening part 9. During assembly, it is only necessary to fasten the longitudinal fastening part 9 in the fastening hole 10 so that the integrated longitudinal adjustment module 2 is modularly assembled with the movable base 1, which is convenient for selective assembly and quick installation and removal as well as DIY assembly of users and conductive to modular production, increasing production efficiency and reducing cost.

Further, as shown in FIG. 1 to FIG. 11, the movable base 1 is provided with a lateral guiding detent 16 which is fastened on the lateral adjustment screw rod 12 and can slide laterally along the lateral adjustment screw rod 12.

Moreover, the movable base 1 is integrated with a lateral guiding convex block 17 and a lateral guiding clamping block 18, the integrated main frame 3 is provided with a lateral guide slot 19 slidably installed with the lateral guiding convex block 17 and a guiding connecting block 20 which is fastened with the lateral guiding clamping block 18 and can slide laterally along the lateral guiding clamping block 18.

Further, as shown in FIG. 1 to FIG. 11, the integrated main frame 3 is provided with a vertical guiding detent 24 which is fastened on the vertical adjustment screw rod 14 and slides longitudinally along the vertical adjustment screw rod 14. The vertical adjustment block 5 is provided with a vertical guide slot 25, a vertical guide groove 26 and a vertical guiding convex block 27 integrated therewith, a vertical guiding clamping block 28 and a vertical guiding connecting position 29.

Wherein the integrated main frame 3 is provided with a vertical connecting convex block 30 matched with and longitudinally slidably installed with the vertical guide slot 25, a guide notch 31 matched with and longitudinally slidably installed with the vertical guiding convex block 27, a vertical connecting block 32 which is fastened with the vertical guiding clamping block 28 and can be longitudinally slidably installed along the vertical guiding clamping block 28, and a vertical guiding fastening block 33 which is clamped with the vertical guiding connecting position 29 and can be longitudinally slidably installed along the vertical guiding connecting position 29.

In addition, the bottom surface of the movable base 1 is integrated with a lateral connecting block 22 which is clamped with the vertical guide groove 26 and can slide laterally.

In this way, the slidable fastening method is adopted to assemble the movable base 1, the integrated adjustment module and the integrated longitudinal adjustment module 2 into a front connection device for modular adjustment of drawer slides by modularization, which is suitable for modular production and conductive to increasing production efficiency and reducing cost as well as realizes the multi-directional adjustment and installation of the drawer, improves the stability and effectiveness of the product, provides the functions of free selective assembly and tool-less installation and removal, facilitates selective assembly DIY and quick tool-less installation and removal of users, and has high applicability.

The above specific embodiments are specific embodiments with good effects of the present invention. Any structure identical or similar to that of the front connection device for modular adjustment of drawer slides of present invention shall be covered in the protection scope of the present invention.

The invention claimed is:

1. A front connection device for modular adjustment of drawer slides, characterized in that: the front connection device for modular adjustment comprises a movable base (1) installed on a drawer, an integrated adjustment module for integrated adjustment of lateral and vertical installation positions of the drawer, and an integrated longitudinal adjustment module (2) for adjusting the longitudinal installation position of the drawer, wherein the integrated longitudinal adjustment module (2) is fastened on the movable base (1) and positionally connected with the front end of a movable slide, and the integrated adjustment module is slidably installed on the movable base (1) and positionally installed with the movable slide;

the integrated adjustment module comprises an integrated main frame (3), a latch handle component (4) and a vertical adjustment component, the integrated main frame is laterally slidably installed on the movable base (1) and positionally installed with the movable slide, the latch handle component (4) is axially connected to the integrated main frame (3) and rotatably fastened on the movable slide with an axis as a fixed point, and the vertical adjustment component is longitudinally slidably installed on the integrated main frame (3) and provided with an inclined plane (51) which is slidably connected with the bottom surface of the movable slide;

the integrated adjustment module is provided with a lateral adjustment component for lateral movement of the movable base (1) under the condition that the positions of connection between the integrated main frame (3), the vertical adjustment component and the latch handle component (4) with the movable slide are kept unchanged when the drawer is laterally adjusted;

the integrated longitudinal adjustment module (2) comprises a longitudinal adjustment base (21), and the longitudinal adjustment base (21) is provided with a longitudinal adjustment component for longitudinal movement of the drawer under the condition that the positions of connection between the integrated main frame (3), the vertical adjustment component, the latch handle component (4) and the movable base (1) with the movable slide are kept unchanged when the drawer is longitudinally adjusted.

2. The front connection device for modular adjustment of drawer slides as claimed in claim 1, characterized in that: the longitudinal adjustment component comprises a longitudinal adjustment wheel (6) and a longitudinal adjustment block (7) with a longitudinal adjustment screw rod (8), the longitudinal adjustment block (7) is longitudinally slidably installed on the longitudinal adjustment base (21), the longitudinal adjustment wheel (6) is in threaded connection with the longitudinal adjustment screw rod (8) and drives the longitudinal adjustment block (7) to longitudinally move relative to the longitudinal adjustment base (21) during rotation of the longitudinal adjustment screw rod (8), and the longitudinal adjustment base (21) is fastened on the movable base (1).

3. The front connection device for modular adjustment of drawer slides as claimed in claim 2, characterized in that: the longitudinal adjustment base (21) is provided with an integrally formed longitudinal fastening part (9), and one side of the movable base (1) is provided with a fastening hole (10) for fastening the longitudinal fastening part (9).

4. The front connection device for modular adjustment of drawer slides as claimed in claim 1, characterized in that: the lateral adjustment component comprises a lateral adjustment wheel (11) and a lateral adjustment screw rod (12) integrated with the integrated main frame (3);

the vertical adjustment component comprises a vertical adjustment block (5), and the vertical adjustment block (5) is provided with a vertical adjustment wheel (13) and a vertical adjustment screw rod (14) integrated with the vertical adjustment block (5);

the latch handle component (4) comprises a movable fastener (41) and a movable handle (42);

the movable handle (42) is axially connected to the integrated main frame (3), and the movable fastener (41) is fastened on the fastening part of the movable handle (42) and fastened on or separated from the movable slide with the swinging of the movable handle (42);

the vertical adjustment block (5) is longitudinally slidably installed on the integrated main frame (3), the inclined plane (51) is arranged on the rear end of the vertical adjustment block (5), and the vertical adjustment wheel (13) is in threaded connection with the vertical adjustment screw rod (14) and drives the inclined plane (51) to longitudinally slide on the bottom surface of the movable slide during rotation of the vertical adjustment wheel (13) to move the drawer up and down;

the integrated main frame (3) is laterally slidably installed on the movable base (1), and the rear end of the integrated main frame (3) is integrated with a positioning connecting block (15) positionally installed with the movable slide;

the lateral adjustment wheel (11) is in threaded connection with the lateral adjustment screw rod (12) and drives the movable base (1) to laterally move relative to the movable slide during rotation of the lateral adjustment screw rod (12).

5. The front connection device for modular adjustment of drawer slides as claimed in claim 4, characterized in that: the movable base (1) is provided with a lateral guiding detent (16) which is fastened on the lateral adjustment screw rod (12) and can slide laterally along the lateral adjustment screw rod (12).

6. The front connection device for modular adjustment of drawer slides as claimed in claim 4, characterized in that: the movable base (1) is integrated with a lateral guiding convex block (17) and a lateral guiding clamping block (18), the integrated main frame (3) is provided with a lateral guide slot (19) slidably installed with the lateral guiding convex block (17) and a guiding connecting block (20) which is fastened with the lateral guiding clamping block (18) and can slide laterally along the lateral guiding clamping block (18).

7. The front connection device for modular adjustment of drawer slides as claimed in claim 6, characterized in that: the integrated main frame (3) is integrated with an elastic connecting block (23) elastically connected with the front end of the movable slide.

8. The front connection device for modular adjustment of drawer slides as claimed in claim 4, characterized in that: the integrated main frame (3) is provided with a vertical guiding detent (24) which is fastened on the vertical adjustment screw rod (14) and slides longitudinally along the vertical adjustment screw rod (14).

9. The front connection device for modular adjustment of drawer slides as claimed in claim 4, characterized in that: the vertical adjustment block (5) is provided with a vertical guide slot (25), a vertical guide groove (26) and a vertical guiding convex block (27) integrated therewith, a vertical guiding clamping block (28) and a vertical guiding connecting position (29);

the integrated main frame (3) is provided with a vertical connecting convex block (30) matched with and longitudinally slidably installed with the vertical guide slot (25), a guide notch (31) matched with and longitudinally slidably installed with the vertical guiding convex block (27), a vertical connecting block (32) which is fastened with the vertical guiding clamping block (28) and can be longitudinally slidably installed along the vertical guiding clamping block (28), and a vertical guiding fastening block (33) which is clamped with the vertical guiding connecting position (29) and can be longitudinally slidably installed along the vertical guiding connecting position (29);

the bottom surface of the movable base (1) is integrated with a lateral connecting block (22) which is clamped with the vertical guide groove (26) and can slide laterally.

* * * * *